US008157959B2

(12) United States Patent
Räsänen et al.

(10) Patent No.: US 8,157,959 B2
(45) Date of Patent: Apr. 17, 2012

(54) BOARD, A METHOD OF MANUFACTURING THE SAME AND A CONTAINER MADE FROM IT

(75) Inventors: Jari Räsänen, Imatra (FI); Tapani Penttinen, Huutjärvi (FI); Niilo Pöyhönen, Helsinki (FI)

(73) Assignee: Stora Enso Oyj, Helsinki (FI)

( * ) Notice: Subject to any disclaimer, the term of this patent is extended or adjusted under 35 U.S.C. 154(b) by 306 days.

(21) Appl. No.: 12/530,657

(22) PCT Filed: Mar. 17, 2008

(86) PCT No.: PCT/FI2008/050118

§ 371 (c)(1),
(2), (4) Date: Sep. 10, 2009

(87) PCT Pub. No.: WO2008/113887

PCT Pub. Date: Sep. 25, 2008

(65) Prior Publication Data

US 2010/0112247 A1 May 6, 2010

(30) Foreign Application Priority Data

Mar. 16, 2007 (FI) ..... 20070213

(51) Int. Cl.

| | |
|---|---|
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 162/168.1; 162/164.1; 162/101

(58) Field of Classification Search ..... 162/164.1, 162/168.1, 101

See application file for complete search history.

(56) References Cited

U.S. PATENT DOCUMENTS 3,977,318 A 8/1976 Cohan
4,435,344 A 3/1984 Iioka (Continued)

FOREIGN PATENT DOCUMENTS

EP 0 940 240 B1 10/2002

(Continued)

*Primary Examiner* — Michael C Miggins

(74) *Attorney, Agent, or Firm* — Birch, Stewart, Kolasch & Birch, LLP

(57) ABSTRACT

The invention relates to a method of manufacturing board (2), a board provided by the method, and a container formed from the same, such as a disposable drinking cup. According to the invention, fiber-based stock is doped with a polymer (6), ending in a pulp web that is formed of this pulp on a board machine wire, and in a board layer (3) that is obtained from the same by pressing and drying. When the board layer is heated, the polymer melts and water vapor bubbles penetrate it, rendering the layer porous. The polymer used for the doping can comprise, for example, a low density polyethylene (LDPE) that has a melt viscosity of about 15. Pore-generating heating can be carried out for the board or only for the container manufactured from it. The porous layer prevents the hot drink enjoyed from the cup from burning the fingers of the user.

19 Claims, 1 Drawing Sheet

U.S. PATENT DOCUMENTS

| | | | |
|---|---|---|---|
| 4,805,758 | A | 2/1989 | Dominico et al. |
| 6,379,497 | B1 | 4/2002 | Sandstrom et al. |
| 6,802,938 | B2 | 10/2004 | Mohan et al. |
| 6,852,381 | B2 | 2/2005 | Debraal et al. |
| 2001/0038893 | A1 | 11/2001 | Mohan et al. |
| 2002/0041046 | A1 | 4/2002 | Hartjes et al. |
| 2004/0211535 | A1 | 10/2004 | Halabisky |

FOREIGN PATENT DOCUMENTS

| | | | |
|---|---|---|---|
| GB | 1118221 | A | 6/1968 |
| GB | 1 297 749 | A | 11/1972 |
| GB | 1 441 666 | | 7/1976 |
| JP | 2005-133061 | A | 5/2005 |

BOARD, A METHOD OF MANUFACTURING THE SAME AND A CONTAINER MADE FROM IT

The invention relates to a method of manufacturing board, wherein a pulp web is formed from fibre-based stock onto the wire of a board machine, the web being pressed and dried into a layer of board. The invention further relates to board obtained by the method and a container made of this board, such as a drinking cup.

One disadvantage of conventional drinking cups without handles, which are made of board, is that the hot drinks placed therein tend to burn the fingers of the user. This is due to the poor thermal insulation capacity of the thin board. For the same reason, drinking a very cold drink from the cup may feel uncomfortable for the fingers.

As a solution to the problem, it has been suggested to alter the structure or the design of the cup. One solution comprises arranging a sleeve made of corrugated board around the jacket of the cup. A double jacket of the cup has also been suggested, wherein an insulating layer of air remains inside the jacket. Furthermore, a board cup is known, its jacket being folded downwards at the mouth of the cup, forming a collar that works as a gripping surface.

Another known approach is to improve the thermal insulation capacity of the cup by incorporating into the pulp microshperes that are expanded by heat, wherein the expansive agent comprises a gas, such as isobutene or pentane. Such expanding particles are available commercially. However, there is the disadvantage of the price of the particles and the difficulty to distribute them evenly in the pulp in the foaming process of the board. The known technology in question is described, among others, in patent specification GB 1118221 and patent specifications U.S. Pat. Nos. 6,379,497 and 6,802,938.

A third solution to the problem has been to improve the thermal insulation capacity of the cup by rendering the polymer coating layer of the cup jacket porous. Patent specification GB 1441666 discloses a board drinking cup, wherein a coating is laminated to the board by means of an adhesive, the coating comprising foamed polystyrene. Patent specification U.S. Pat. No. 4,435,344 and published application EP 940240 describe board cups that are coated with a layer of foamed low density polyethylene (LDPE). According to the publications, the LDPE layer is foamed with the water vapour that releases from the board when heated, the vapour penetrating the molten polymer layer of the cup, making it porous. Patent specification U.S. Pat. No. 6,852,381 further describes a foaming method of the polymer coating of board cups, which is based on encapsulated isobutylene that is gasified, when heated.

As a result of foaming the polymer coating of the board cup, the surface of the cup becomes uneven. If the gas bubbles that accumulate or are generated in the coating during foaming break the jacket surface of the cup, the surface becomes rough. The foamed porous polymer coating improves the thermal insulation capacity of the cup body, but there is the disadvantage that the quality of the prints on the cup deteriorates. For example, on board coated with low density polyethylene (LDPE) or ethylene-methyl acrylate copolymer (EMA), high-quality print can be produced by the dry toner-based digital printing technique, its accuracy being impaired by the bumps and cracks that are generated on the surface.

The purpose of the invention is to solve the problem mentioned above by forming porous board, i.e. paperboard or cardboard, that is suitable for the material of drinking cups or similar containers, in particular, its surface being smoother than before, thus enabling a more high-quality print on the jacket surface of the cup. The method of manufacturing the board according to the invention is characterized in that polymer is incorporated into the stock, ending in the board layer, and that the board layer containing humidity is heated so that the polymer melts and water vapour bubbles penetrate into it, making the layer porous.

Compared with the references mentioned above, U.S. Pat. No. 4,435,344, EP 940240, and U.S. Pat. No. 6,852,381, an essentially novel feature in the invention is that the polymer is foamed with vapour inside the fibre-based board layer so that the thermal insulation capacity of the board improves because of the pore-forming in this layer. Foaming of the polymer expands the fibre-based board layer more evenly, producing less cracking of the surface than the foaming of the polymer coating layer of the board. In particular, this is the case when the board is provided with a polymer coating that remains infusible and non-foaming during heating.

The polymer can be doped into dry fibres as small particles or drops, which adhere to the fibres, being mainly evenly distributed in the pulp. Doping of polymer can also be carried out for part of the fibres, which are then mixed with undoped fibres. The doped pulp thus obtained is suspended in water as stock, which in a conventional manner is fed onto the wire in the board machine and pressed and dried into a board web, which can become part of the multilayer board that is produced by the machine. In such a multilayer board, one or more fibre-based layers can include doped polymer that is capable of foaming. The polymer can constitute 5 to 40 percent, preferably 10 to 20 percent of the dry weight of the doped fiber-based layer.

In order to melt and foam it, when heated, the melt viscosity of the doped polymer should preferably be at least 15. The polymer used in the invention comprises low density polyethylene (LPDE), for example. The heating temperature may vary within 110 and 150° C., and when using LDPE, preferably within 115 and 125° C.

The foaming of the polymer incorporated into the fiber-based board layer is generated by the humidity released from the board in heating, penetrating into the molten polymer particles, making them foam and expand. Furthermore, the polymer as such may contain humidity, which for its part causes bubbling and foaming, when heated. When the board cools after foaming, the vapor bubbles of the foam remain as cavities and pores in the solidifying, expanded polymer.

Generally, board that is intended for drinking cups is coated with polymer on both sides thereof. The purpose of the coating layers is to prevent the water absorption of the board and to enable the heat sealing of the cups. If the coating and the doping of the board layer fibers are made with the same polymer, the coating layers can also foam to some extent, when the polymer incorporated into the board layer is foamed, even if the foaming of the surface layers is essentially lesser than in the solutions disclosed in the references mentioned above. It is also possible that a polymer with a lower melt viscosity or a higher melting point is used either in one or both coating layers so that, when foaming the polymer in the board layer, the coating layer(s) neither melt nor foam. Thus, it is possible to keep the polymer surface of the board solid and smooth, while the foaming potential can essentially be directed in full to the polymer incorporated into the fiber layer. For example, the fibers of the board layer can be doped with an LDPE having a higher melt viscosity, and the board can be coated with the same LDPE on one side thereof, and with an LDPE having a lower melt viscosity or with a high density polyethylene (HDPE) on the opposite side thereof, and the LDPE doped into the board layer can be foamed by heating the board to a temperature range of about 115 to 125°

C. so that the temperature remains below the melting temperature of the coating polymer (LDPE or HDPE) of the said opposite side. It is especially preferable to coat the board with a polymer having a lower melt viscosity or a higher melting point on both sides thereof, whereby the coating layers prevent the escape of water vapor and the foaming potential is exclusively directed at the doped polymer having a higher melt viscosity or a lower melting point.

The pore forming of board based on the foaming of polymer can take place in the board machine before reeling the finished board. Such a board as such is suitable to the manufacture of heat-insulated board drinking cups, among others. It is also possible to manufacture containers, such as drinking cups, from the board produced by the machine, their board not being foamed by heating until in the cup machine or by directing the heating at the finished cups.

The board, that is paperboard or cardboard, manufactured according to the invention is characterized in that at least one polymer-bearing fiber layer of the board contains cavities generated by the gas bubbles in the polymer. The board container according to the invention is characterized in consisting of such a porous board manufactured according to the invention. Typically, the container according to the invention is a drinking cup, the porous board of its body preventing the hot drink from burning the fingers of the user.

In the following, the invention is described in detail with the aid of examples and with reference to the appended drawing, wherein FIG. 1 shows the heating of board drinking cups to foam and expand the polymer that is doped into the fiber layer of the board;

In addition to the disposable drinking cups or other board containers produced according to the drawings, the thermal insulation capacity of their bodies being improved by foaming the polymer that is doped into the board layer, the invention also relates to board suitable for such containers, and to its manufacturing method.

The board according to the invention can be manufactured by a board machine, the stock that is fed into its head box containing fibers doped with a polymer, such as LDPE, its melt viscosity being about 15, the polymer in the fibers being adhered to the fibers as small drop-like particles. The doping carried out by the polymer can be directed at the stock used as pulp in its entirety, or at a part of it only, whereby in the latter case, the doped fibers are homogeneously mixed with undoped fibers. The portion of polymer from the dry weight of the pulp fibers can be 5 to 40% by weight, preferably 10 to 20% by weight.

Thereafter, the manufacture of board by the board machine continues in a conventional manner. A pulp web is formed from the stock that is lead from the head box to the machine wire, the web being pressed and dried into a layer of board. Typically, several webs are produced by the machine, which are combined into a multi-layer board. One or more of these layers can contain fibers doped with polymer. For example, three-layer folding board can be manufactured, its middlemost layer of chemithermo-mechanical pulp (CTMP) containing doped fibers, and the fibers of the kraft pulp layers that are on both sides thereof are un-doped.

The board used in drinking cups is usually provided with a polymer coating on both sides thereof, enabling the heat sealing of blanks into cups and preventing the water absorption of the board in the cups. Typical coating polymers of cups include polyolefins, such as LDPE and HDPE.

An essential feature of the invention comprises heating the fiber layer that is included in the board and doped with polymer, so that the polymer melts and vapor bubbles are formed in it; in other words, the polymer becomes foamed. The bubbles render the polymer and, along with that, the doped board layer porous, and the porosity remains, when the layer cools and the polymer in the foamed state solidifies. The pore forming may take place as early as in the board machine before the finished board is reeled on a machine roll, but it can also take place later on, after coating the board with polymer, or not until after the coated board has been formed into cups in the cup machine. The appended drawing shows a case of such pore forming of board carried out on finished drinking cups to improve the thermal insulation capacity of the cup bodies.

Figure 1:
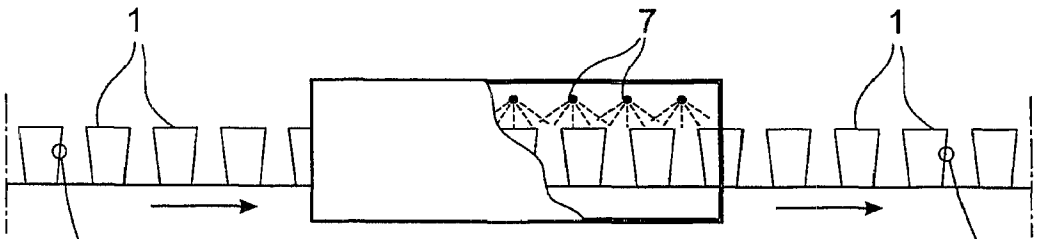
Figure 2:
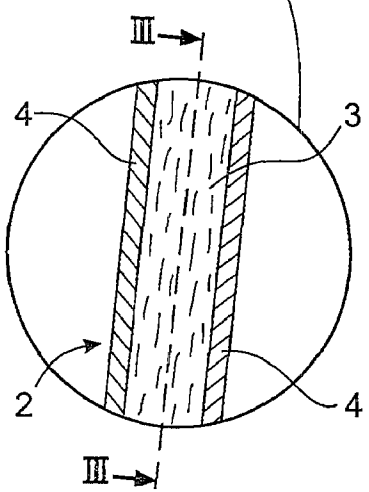
FIG. 2 is a section of the polymer-coated board of the cup body before heating.
Figure 3:
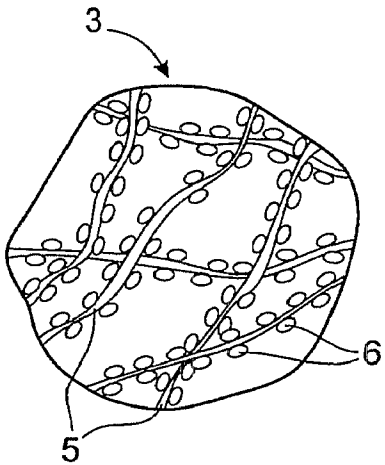
FIG. 3 shows, on an enlarged scale, the fiber layer doped with polymer as a section of FIG. 2.

Heating of the drinking cups 1, which are made of polymer-coated board, to foam the board is shown in FIG. 1, and FIG. 2 shows a cross section of board 2, which comprises a layer of board 3 and polymer coating layers 4 on both sides thereof. In a manner known as such, the board layer 3 can consist of several material layers that are joined to each other by the board machine. A polymer with a high melt viscosity, such as the said LDPE that has a melt viscosity of about 15, has been doped into at least one fiber-based material layer of the board layer 3 or the multi-layer board, the polymer being adhered to fibers 5 as small drops or particles 6, according to FIG. 3. The polymer coating layer 4 of the inner surface of the cup can comprise the same polymer (LDPE) as that used in doping the fiber layer 3, and the coating layer 4 of the cup's outer surface can comprise a polymer that has a lower melt viscosity or a higher melting point, such as LDPE with a melt viscosity of about 4.5 to 7.5, or HPDE that melts at a higher temperature. Alternatively, in each coating layer 4, LDPE with a melt viscosity of about 4.5 to 7.5 or HDPE can be used, for example.

In the process according to FIG. 1, the jacket board 2 of drinking cups 1 according to FIG. 2 is foamed by heating that is generated by infrared or microwave radiators 7. The radiation heats the board layer 3 and the polymer particles 6 that have been doped thereto, to a temperature wherein these polymer particles melt but the coating polymer 4, which has the lower melt viscosity or the higher melting point, does not melt. When using, for the doping, a polymer that has a melt viscosity of at least about 15, such as LDPE, a suitable heating temperature is about 115 to 125° C.

Figure 4:
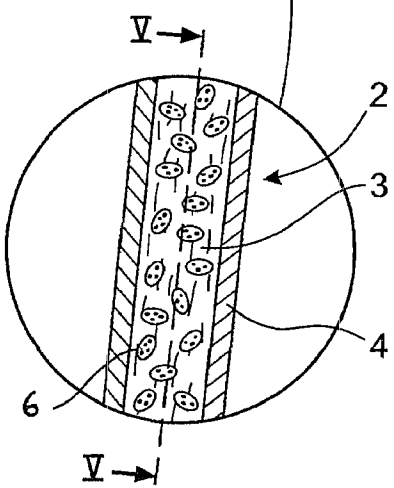
FIG. 4 shows, corresponding to FIG. 2, a section of the cup body after the heating and foaming process.
Figure 5:
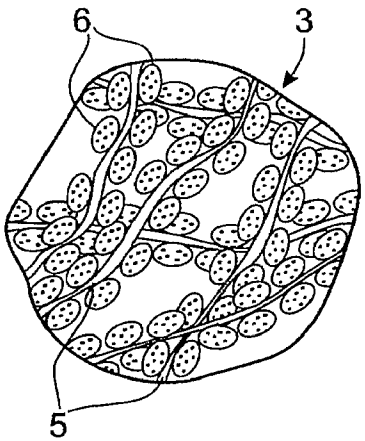
FIG. 5 shows, corresponding to FIG. 3, the fiber layer as a section V-V of FIG. 4, where the doped polymer is foamed and expanded.

In addition to melting the doping polymer 6, it is essential for the invention that the heating is sufficient to evaporate the humidity inherently contained in the board layer 3. Vapor in bubble form penetrates the molten polymer particles 6, making them foam. On the contrary, the polymer coating layers 4 do not foam, unless melting occurs in them. For example, if the polymeric layer 4 of the inner surface of cup 1 comprises the same LDPE as the doping polymer 6, foaming caused by the humidity evaporating also occurs therein. After the heating and the foaming of polymer, the drinking cups 1 are cooled, whereby the bubbles generated by the vapor leave the solidifying polymer porous. FIG. 4 is a section of the board jacket 2 of the heat-treated drinking cup 1 with its board layers 3 that have been made porous by foaming the polymer, and with its non-foamed polymer coating layers 4, and FIG. 5 shows the board layer 3 with its fibers 5 and polymer particles, which have been expanded and made porous by foaming. In the foaming, the volume of the polymer particles 6 can increase to 10 to 100-fold, for example, and they can also be fused into each other so as to have an advantageous effect that stiffens the board and the cup or the similar container made of the same.

It is obvious to those skilled in the art that the applications of the invention are not limited to the example described above, but they can vary within the following claims. Instead of polyolefins, the doping and coating polymers can comprise polymers that have a corresponding melt viscosity or melting temperature, which can preferably be biodegradable, such as polylactides (PLA) and biodegradable copolyesters. In addition to polymer, it is also possible to dope, into the fibers constituting the stock, gas capsules, which degrade when heated so that the gas is released and it enhances the foaming of polymer that takes place in the board layer. Another feasible foaming booster comprises an inorganic compound that is added to the fibers, such as hydroxide, e.g., $Mg(OH)_2$, or a hydrous salt, which releases water vapor when heated, the vapor foaming the polymer.

The invention claimed is:

1. A method of manufacturing board, wherein a pulp web is formed from fiber-based stock on a board machine wire, the web being pressed and dried into a board layer, characterized in that polymer is incorporated into the stock, ending in the board layer, and that the board layer containing humidity is heated so that the polymer melts and water vapor bubbles penetrate the same, the water vapor foaming and expanding the polymer and rendering the board layer porous.

2. A method according to claim 1, characterized in that the middle layer of a three-layer folding board is made porous by means of the polymer.

3. A method according to claim 1, characterized in that the heating is effected by hot-air heating or infrared or microwave radiation.

4. A method according to claim 1, characterized in that the fibers are doped with the polymer and mixed with undoped fibers, and that the stock comprising the fiber mixture thus obtained is supplied to the wire.

5. A method according to claim 1, characterized in that the pores produced in the board machine before the finished board is reeled.

6. A method according to claim 1, characterized in that containers, such as drinking cups, are formed from the board produced by the machine, their board layer being rendered porous by heating that melts the polymer and generates vapor bubbles.

7. A method according to claim 1, characterized in that the melt viscosity of the polymer is at least about 15.

8. A method according to claim 1, characterized in that the heating temperature is about 110 to 150° C., preferably about 115 to 125° C.

9. A method according to claim 8, characterized in that the board is moistened before the heating that produces water vapor bubbles.

10. A method according to claim 1, characterized in that the board is provided with a polymer coating on both sides thereof before the heating that produces the water vapor bubbles.

11. A method according to claim 10, characterized in that in the coating at least on one side of the board, there is used a polymer same as the polymer, which is added to the stock and which makes the board porous.

12. Board manufactured by the method according to claim 1, characterized in that at least one polymer-bearing fiber layer of the board contains cavities generated by water vapor bubbles in the polymer.

13. Board according to claim 12, characterized in that its both sides are provided with polymer coatings.

14. A method according to claim 1 or 7, characterized in that the polymer comprises low density polyethylene (LDPE).

15. A method according to claim 10 or 11, characterized in that the polymer, which is used in the coating at least on one side of the board, has a lower melt viscosity or a higher melting point than the polymer, which is added to the stock and which makes the board porous.

16. A board container, characterized in comprising the board according to claim 12 or 13.

17. A container according to claim 16, characterized in being a board drinking cup.

18. A container according to claim 17, characterized in that the polymer that makes the board layer porous comprises a polymer that has a higher melt viscosity, that the inner surface of the cup comprises the same polymer having said higher melt viscosity, and that the outer surface of the cup comprises a polymer that has a lower melt viscosity.

19. A container according to claim 17, characterized in that the inner or the outer surfaces of the cup are coated with a polymer, which has a lower melt viscosity or a higher melting point than the polymer that makes the board layer porous.

* * * * *